US009358674B2

(12) United States Patent
Lasaga

(10) Patent No.: US 9,358,674 B2
(45) Date of Patent: Jun. 7, 2016

(54) HAND TOOL FOR REMOVING NAILS

(71) Applicant: Richard John Lasaga, Woodbridge (CA)

(72) Inventor: Richard John Lasaga, Woodbridge (CA)

( * ) Notice: Subject to any disclaimer, the term of this patent is extended or adjusted under 35 U.S.C. 154(b) by 137 days.

(21) Appl. No.: 14/028,672

(22) Filed: Sep. 17, 2013

(65) Prior Publication Data

US 2015/0076425 A1 Mar. 19, 2015

(51) Int. Cl.
*B25C 11/00* (2006.01)

(52) U.S. Cl.
CPC ..... *B25C 11/00* (2013.01)

(58) Field of Classification Search
CPC ..... B25C 11/00
USPC ..... 254/21; D8/89
See application file for complete search history.

(56) References Cited

U.S. PATENT DOCUMENTS 178,407 A * 6/1876 Butts ..... B25C 11/00 254/25
461,688 A * 10/1891 Scott ..... B25C 11/00 254/25
D30,322 S * 3/1899 Austin ..... 254/26 R
795,876 A * 8/1905 Willhide ..... 254/25
D45,761 S * 5/1914 Miller ..... 254/26 R
D52,960 S * 2/1919 Nelson ..... D8/89
1,392,765 A * 10/1921 Hunter ..... B25C 11/00 254/25
2,103,008 A * 12/1937 Kinast ..... B25F 1/00 254/21
2,525,226 A * 10/1950 Lawellin ..... B25C 11/00 254/131
3,599,255 A * 8/1971 Carroll, Sr. ..... B25F 1/00 254/26 R
D318,211 S * 7/1991 D'Onofrio ..... D8/89
5,577,711 A * 11/1996 Shine ..... E04D 15/003 254/25
5,695,171 A * 12/1997 Shine ..... 254/25
5,768,956 A * 6/1998 Coonrad ..... B25D 1/00 254/25
6,460,210 B1 * 10/2002 Alpert ..... B25C 11/00 7/144
8,534,643 B2 * 9/2013 Lombardi ..... B25G 1/10 254/21
2001/0025949 A1 * 10/2001 Fagan ..... 254/25
2003/0030044 A1 * 2/2003 Youngren ..... B25C 11/00 254/19
2006/0197070 A1 * 9/2006 Eby ..... B25C 11/00 254/25
2007/0226913 A1 * 10/2007 Woolley ..... B25F 1/00 7/146
2008/0072713 A1 * 3/2008 Chen ..... B25B 11/00 81/46
2009/0000039 A1 * 1/2009 St. John et al. ..... 7/138
2009/0271929 A1 * 11/2009 Adams et al. ..... 7/144
2009/0276962 A1 * 11/2009 Adams ..... B25D 3/00 7/144
2010/0237301 A1 * 9/2010 Eric ..... 254/25
2012/0110745 A1 * 5/2012 Hanlon ..... B25F 1/00 7/138

FOREIGN PATENT DOCUMENTS

CH 297105 A * 3/1954 ..... B25C 11/00
DE 202014002568 U1 * 4/2014 ..... B25C 11/00

* cited by examiner

*Primary Examiner* — Joseph J Hail
*Assistant Examiner* — Marc Carlson
(74) *Attorney, Agent, or Firm* — Elias Borges

(57) ABSTRACT

Herein is disclosed a hand tool for removing nails. The tool includes an elongated handle having opposite first and second ends with a blade projecting transversely from a side of the elongated handle at the first end thereof. The blade is sickle shaped and curved towards the second end. The blade has a front edge contiguous with the first end. The blade has a width which tapers from the elongated handle to a pointed tip opposite the elongated handle. Finally, a nail hooking notch is formed on a back edge of the blade opposite the front edge.

9 Claims, 3 Drawing Sheets

HAND TOOL FOR REMOVING NAILS

FIELD OF THE INVENTION

The invention relates generally to hand tools for removing nails.

BACKGROUND OF THE INVENTION

Renovating the roof of a building requires workers to pull out roofing nails which secure the roof's shingles. This is generally accomplished using either a claw hammer or a nail pulling pry bar since the nails are easily exposed. However, at the junction between a roof and a vertical wall, various flashings and channels are used to form a weather proof seal between the roof and the wall. These flashings and other components make accessing the roofing nails securing the shingles immediately adjacent the wall difficult to access without first removing the flashings and other various components. This requires a considerable amount of effort, so workers often compromise by not removing that portion of the shingle immediately adjacent the vertical wall. A hand tool which would make it easy to remove the roofing nails immediately adjacent the vertical walls would allow a worker to quickly and completely remove the roof shingles without having to disassemble or damage the roof flashings.

SUMMARY OF THE INVENTION

In accordance with one aspect of the present invention, there is provided a hand tool for removing nails. The tool includes an elongated handle having opposite first and second ends with a blade projecting transversely from a side of the flat elongated handle at the first end thereof. The blade is sickle shaped and curved towards the second end. The blade has a front edge contiguous with the first end. The blade has a width which tapers from the elongated handle to a pointed tip opposite the elongated handle. Finally, a nail hooking notch is formed on a back edge of the blade opposite the front edge.

In accordance with another aspect of the present invention, there is provided a hand tool for removing nails consisting of an elongated handle having opposite first and second ends and opposite first and second sides. A first blade is formed on the first end, the first blade projecting from the first side of the elongated handle roughly perpendicularly away from the elongated axis. The first blade has a back edge oriented towards the second end of the elongated handle, a front edge opposite the back edge, a base where the blade meets the elongated handle and a tip opposite the base. The first blade is narrower at the tip than at the base. The front edge of the first blade is curving back towards the second end of the elongated handle from the base to the tip. At least one nail hooking notch formed on the back edge of the first blade.

In accordance with another aspect of the present invention, there is provided a hand tool for removing nails, the tool consisting of an elongated handle having opposite first and second ends with a flat member shaped as a double ended blade having opposite first and second pointed tips extending transversely from the first end. The double ended blade is crescent shaped such that the first and second pointed tips extend towards the second end of the elongated handle. The double ended blade has a width which tapers from a base portion adjacent the elongated handle to each of the first and second pointed tips. The double ended blade also has a front contiguous edge and first and second back edges opposite the front contiguous edge, the first and second back edges on opposite sides of the elongated handle. At least one nail hooking notch is formed on each of the first and second back edges.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
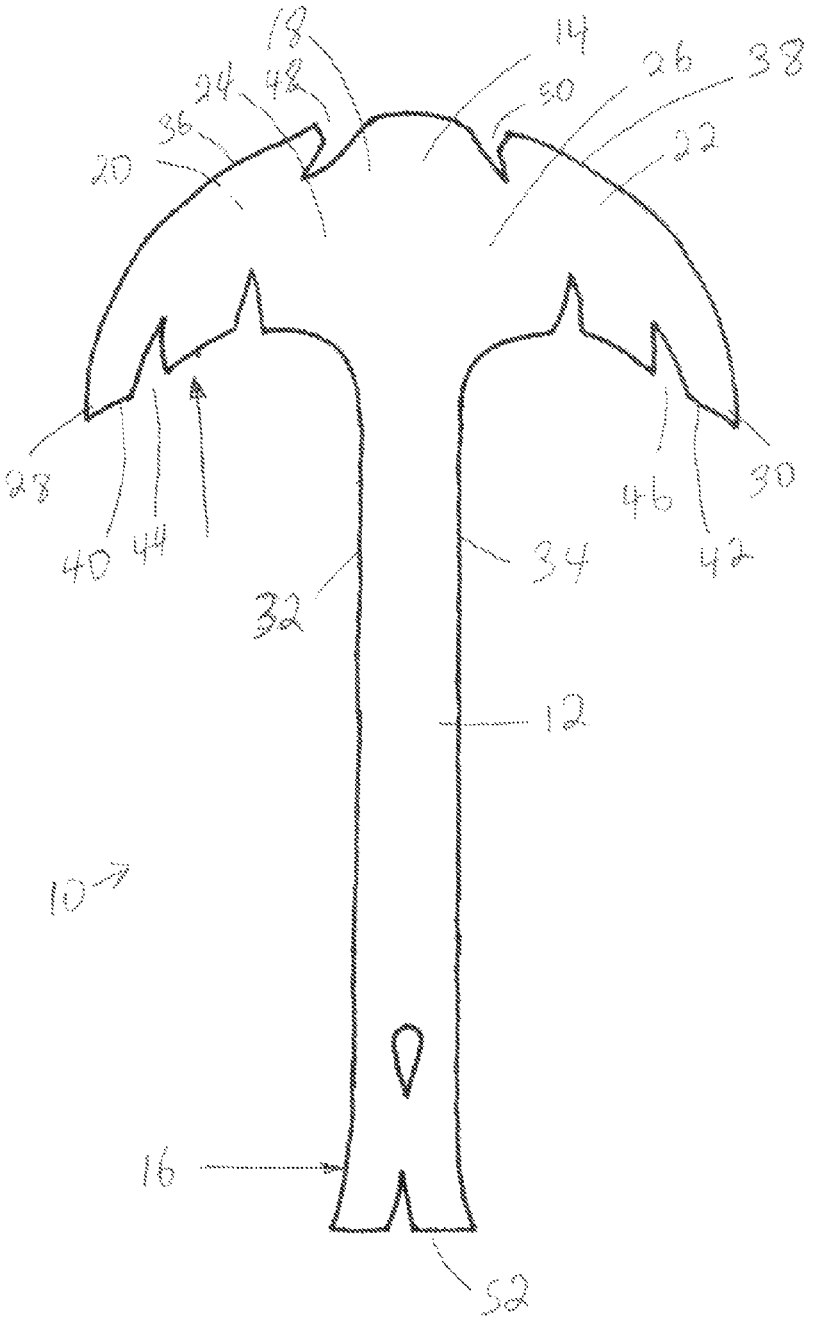
FIG. 1 is a top view of a nail pulling hand tool made in accordance with the present invention.
Figure 2:
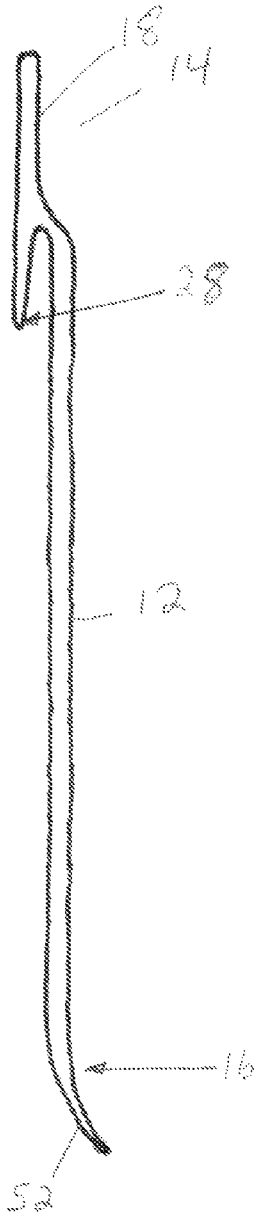
FIG. 2 is a side view of a nail pulling hand tool made in accordance with the present invention.

Referring to FIGS. 1, a nail pulling hand tool made in accordance with the present invention, shown generally as item 10, consists of an elongated handle 12 having opposite ends 14 and 16. Double blade 18 projects transversely away from end 14 and consists of first blade 20 and second blade 22. First blade 20 and second blade 22 each comprise a flat sickle shaped member having a base portion 24 and 26, respectively and a pointed tip 28 and 30, respectively. Blade 20 projects transversely away from side 32 of elongated handle 12 and blade 22 projects transversely away from side 34 of elongated handle 12. Blade 20 has a front edge 36 and back edge 40. Front and back edges 36 and 40 curve back towards end 16 to form the sickle shape. Likewise, blade 22 has front edge 38 and back edge 42 which curves back towards end 16. Front edges 36 and 38 are contiguous while back edges 40 and 42 are positioned on either side of elongated handle 12. Nail hooking notches 44 and 46 are formed on the back edges of blades 20 and 22, respectively, and nail hooking notches 48 and 50 are formed on the front edges of blades 20 and 22, respectively. A nail hooking/pulling pry bar 52 is formed on end 16 of elongated handle 12. As best seen in FIG. 2, blade 18 is set off from elongated handle 12 such that the blade and elongated are parallel, but not coplanar.

Figure 3:
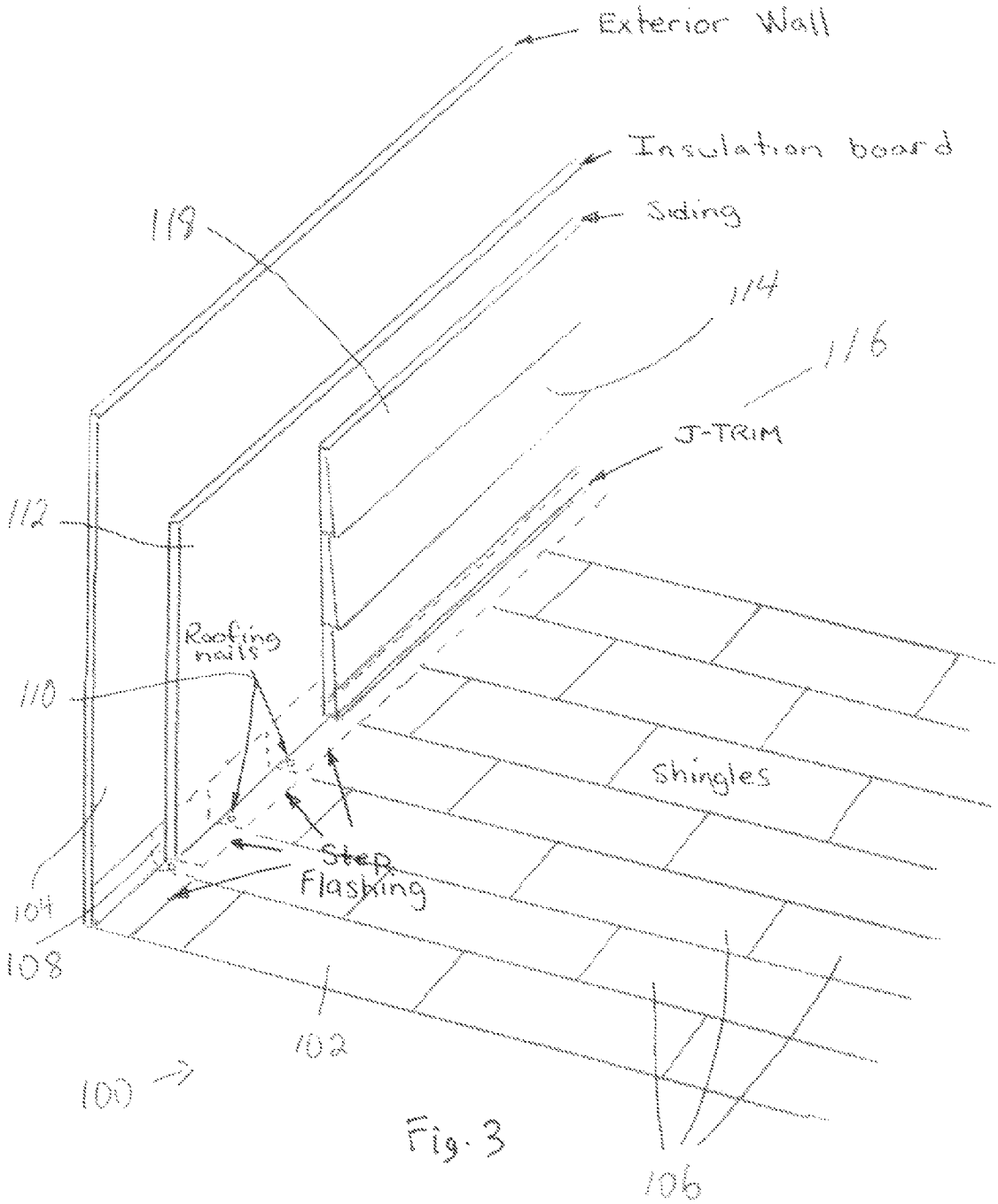
FIG. 3 is a perspective view of part of roof of a building partly disassembled showing the relationship between the shingles, the step flashing and the nails which are to be removed using the nail pulling hand tool shown in FIG. 1.

Referring now to FIG. 3, the nail pulling tool made in accordance with the present invention, is designed to make it easier and quicker for a user to remove roofing nails which are located below step flashing. As shown in FIG. 3, roof 100 consists of a flat angled roof panel 102 upon which shingles 106 are nailed. Where roof panel 102 abuts exterior wall 104, special flashings and trims must be applied to ensure that a water proof seam linking the roof panel to the wall is maintained. This seam is formed by the use of metal step flashing 108 over top of shingles 106 where the shingles meet wall 104. Over top of this, insulation 112 is mounted, and over top the insulation, is siding 118. A length of trim 116, usually in the form of a channel, is placed over top of the step flashing in order to mount siding 118. As can be seen from FIG. 3, the edge of shingles 106 closest to wall 104 are held down by nails 110, which are located underneath step flashing 108, insulation 112, trim 116 and siding 114. The hand tool made in accordance with the present invention allows for the quick removal of these nails without having to disassemble the various component parts such as trim 116, siding 114, insulation 112 and step flashing 108. The tool is designed to enable the user to insert the blade portion of the tool underneath an edge of the step flashing and then hook and pull out the nail by simply swinging the tool as better described below.

Figure 4:
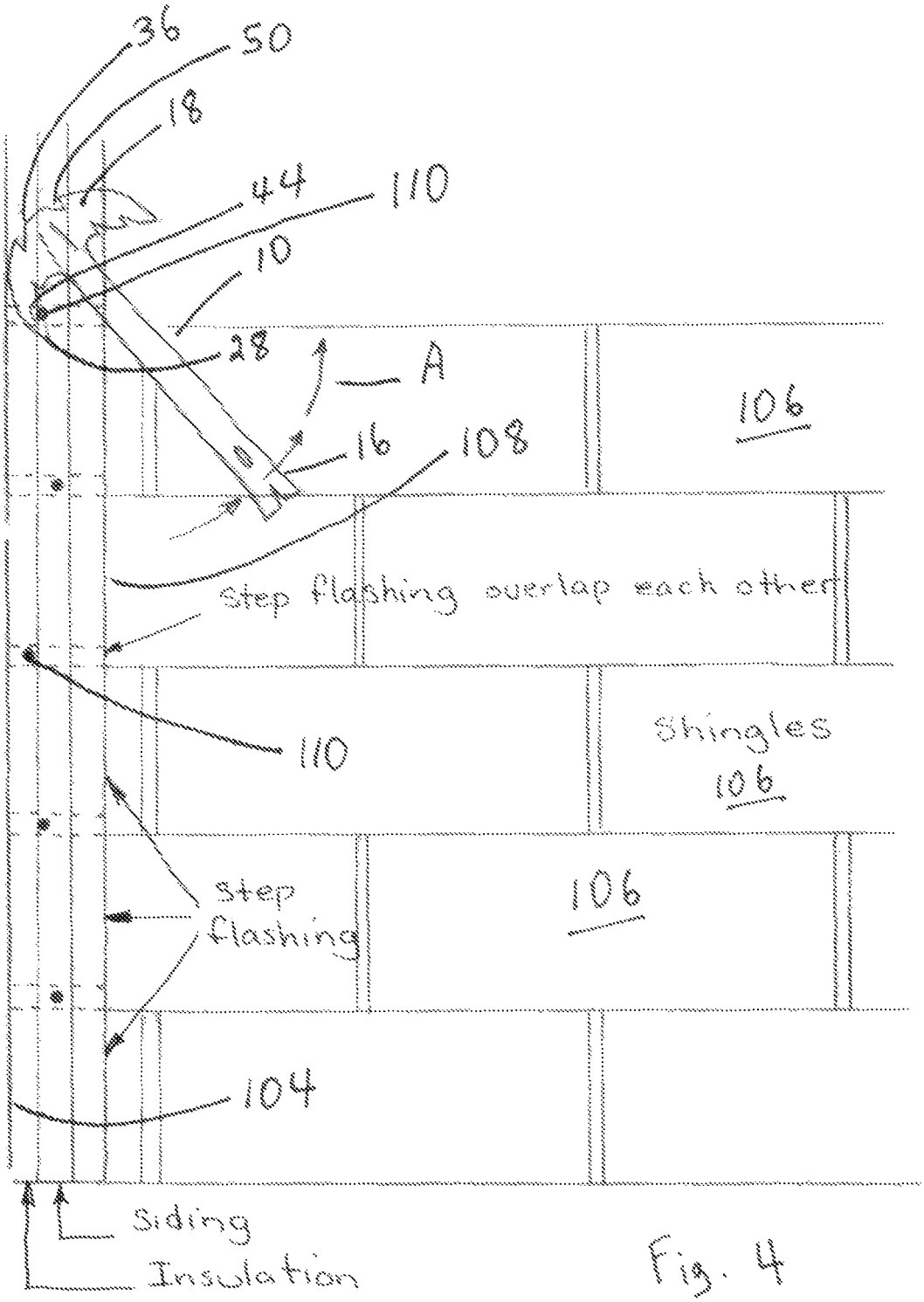
FIG. 4 is a top view showing a nail pulling device made in accordance with the present invention being used to pull out a nail.

Referring now to FIG. 4, in order to remove nail 110 from underneath step flashing 108, the user inserts the nail hooking/pulling pry bar tool 52 to loosen and separate the steps and shingles, allowing space to insert blade 18 between the step flashing and shingle 106 and position pointed tip 28 of the blade between the nail and exterior wall 104. The user does not need to know the exact location of the nail (it will be visible to the user from the side), but can instead use tool 52 to loosen and separate step shingles allowing the user to probe for the nail. When the user positions tip 28 between the nail and the wall, the user can then adjust the tool such that the nail is hooked by nail hook 44. The user then pulls on end 16 of the tool in the direction indicated by arrow A (away from wall 104) to force front edge 36 of the tool against wall 104, thereby prying nail away. Since front edge 36 is curved, the front edge contacts the wall and acts as a fulcrum, allowing the tool to impart a mechanical advantage to the user allowing the user to easily pull out the nail without exerting much force. The user thereby pulls out the nail transversely from the underlying shingle without disturbing or damaging the flashing or other components.

Tool 10, having a double ended blade 18, can be used either in the right or left hand. Also, the user may use front nail hooks 50 or 48 (see FIG. 1) in a very similar fashion. The front nail hooks are used for difficult access areas, such as under soffits and valleys. To use the front nail hooks, the user uses tool 10 to probe for a nail, and when one is found, the user moves blade 18 to place the nail within one of the front nail hooks. The user then pushes against end 16 towards wall 104, which causes the tool to rotate about blade 18. Again, front edge 36 and wall 104 act as a fulcrum, allowing the user a mechanical advantage to pull out the nail easily.

As can be appreciated, when removing roofing nails from the roof, most of the nails will not be placed near wall 104. The user can again use tool 10, but using the nail prying portion of the tool formed on end 16. This allows the user to use one tool in one hand to quickly remove all of the roofing nails, without switching tools.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims Therefore, what is claimed is:

1. A hand tool for removing nails, the tool comprising:

a. an elongated handle having opposite first and second ends positioned along a longitudinal axis;

b. a thin flat blade having a uniform thickness attached to the handle first end, the flat blade projecting transversely from both sides of the longitudinal axis and curved towards the handle second end forming a crescent shaped blade profile with opposing crescent shaped blade surfaces, the crescent shaped blade profile bounded on a distal end by a front edge surface curving back toward the second end on both sides of the longitudinal axis and bounded on the handle first end by two back edge surfaces located on opposite sides of the longitudinal axis and curving back towards the second end, the front edge surface and the back edge surfaces shaped to form a blade width that transversely tapers from the longitudinal axis to a substantially pointed tip where the front edge surface and the two back edge surfaces intersect, c. at least one forward facing nail removing notch formed through both the opposing crescent shaped blade surfaces and through the front edge surface of the flat blade oriented away from the handle second end, d. at least one backward facing nail removing notch formed through both the opposing crescent shaped blade surfaces and through at least one of the two back edge surfaces of the flat blade oriented towards the handle second end.

2. The hand tool of claim 1 wherein the second end of the elongated handle is formed as a nail pulling pry bar.

3. The hand tool of claim 1, wherein the blade is set off from the elongated handle such that the blade and the elongated handle are not coplanar.

4. The hand tool of claim 1, comprising two of the forward facing nail removing notches formed through both the opposing crescent shaped blade surfaces and through the front edge surface of the flat blade oriented away from the handle second end.

5. The hand tool of claim 4, comprising two of the backward facing nail removing notches formed through both the opposing crescent shaped blade surfaces and through at least one of the two back edge surfaces of the flat blade oriented towards the handle second end.

6. The hand tool of claim 4, comprising two of the backward facing nail removing notches formed through both the opposing crescent shaped blade surfaces and through both of the two back edge surfaces of the flat blade oriented towards the handle second end.

7. A hand tool for removing nails, the tool comprising:

a. an elongated handle having opposite first and second ends positioned along a longitudinal axis;

b. a thin flat blade having a uniform thickness attached to the handle first end, the flat blade projecting transversely from both sides of the longitudinal axis and curved towards the handle second end forming a crescent shaped blade profile with opposing crescent shaped blade surfaces, the crescent shaped blade profile bounded on a distal end by a front edge surface curving back toward the second end on both sides of the longitudinal axis and bounded on the handle first end by two back edge surfaces located on opposite sides of the longitudinal axis and curving back towards the second end, the front edge surface and the back edge surfaces shaped to form a blade width that transversely tapers from the longitudinal axis to a substantially pointed tip where the front edge surface and the two back edge surfaces intersect, c. at least two forward facing nail removing notch formed through both the opposing crescent shaped blade surfaces and through the front edge surface of the flat blade oriented away from the handle second end, d. at least one backward facing nail removing notch formed through both the opposing crescent shaped blade surfaces and through both of the two back edge surfaces of the flat blade oriented towards the handle second end e. wherein the blade is set off from the elongated handle such that the blade and the elongated handle are not co-planar.

8. The hand tool of claim 7, wherein the second end of the elongated handle is formed as a nail pulling pry bar.

9. The hand tool of claim 8, comprising two of the backward facing nail removing notches formed through both the opposing crescent shaped blade surfaces and through both of the two back edge surfaces of the flat blade oriented towards the handle second end.

* * * * *